US010520219B2

(12) United States Patent
Teraoka et al.

(10) Patent No.: US 10,520,219 B2
(45) Date of Patent: Dec. 31, 2019

(54) HOT AIR NOZZLE AND ITS PRODUCTION METHOD

(71) Applicant: Hakko Corporation, Osaka (JP)

(72) Inventors: Yoshitomo Teraoka, Osaka (JP); Hisao Nemoto, Osaka (JP)

( * ) Notice: Subject to any disclaimer, the term of this patent is extended or adjusted under 35 U.S.C. 154(b) by 878 days.

(21) Appl. No.: 15/158,438

(22) Filed: May 18, 2016

(65) Prior Publication Data

US 2017/0336098 A1 Nov. 23, 2017

(51) Int. Cl.
*F24H 3/04* (2006.01)

(52) U.S. Cl.
CPC ..... *F24H 3/04* (2013.01)

(58) Field of Classification Search
CPC ..... F24H 3/04
USPC ..... 392/379–385; 239/418, 423, 518, 520, 239/538, 549, 568; 34/96, 97, 98, 283; 219/222
See application file for complete search history.

(56) References Cited

U.S. PATENT DOCUMENTS 5,750,964 A * 5/1998 Counts ..... A24F 47/008 131/194
2015/0125798 A1* 5/2015 Swanick ..... F23Q 7/14 431/6

FOREIGN PATENT DOCUMENTS

| | | |
|---|---|---|
| CN | 202188644 U | 4/2012 |
| CN | 104613681 A | 5/2015 |
| JP | 1993299831 | 11/1993 |
| JP | 1996046351 | 2/1996 |
| JP | A1996046351 | 2/1996 |
| JP | A1999330688 | 11/1999 |
| JP | A1999354918 | 12/1999 |
| JP | A2000031217 | 1/2000 |
| JP | A2000124596 | 4/2000 |
| JP | A2006228771 | 8/2006 |

* cited by examiner

*Primary Examiner* — Lorne E Meade
*Assistant Examiner* — Ket D Dang
(74) *Attorney, Agent, or Firm* — David B. Abel

(57) ABSTRACT

The invention is directed to a nozzle for a hot air device used in the electronic assembly industry to melt solder or heat shrink-wrap insulators. The nozzle provides a uniform temperature environment and suppresses the occurrence of local excess heating.

11 Claims, 6 Drawing Sheets

HOT AIR NOZZLE AND ITS PRODUCTION METHOD

FIELD OF THE INVENTION

The present invention relates to a nozzle for a hot air device used in the electronic assembly industry to melt solder or heat shrink-wrap insulators. The nozzle provides a uniform temperature environment and suppresses the occurrence of local excess heating.

BACKGROUND OF THE INVENTION

In the electronics fabrication and re-working field, a hot air device is often used to melt solder when a user is required to dismount or remove and replace an electrical component. Hot air may also be used to heat shrink-wrap insulation materials. However, when hot air is blown on a targeted electronic device directly, the thermal energy may be undesirably transmitted to other electronic elements adjoining the targeted device. This inadvertent heat transfer occurs with contemporary nozzles because the nozzles are held above or floated over a substrate and the targeted device, and the hot air must exhaust via the space between the nozzle and the substrate. When the user wants to prevent thermal energy from transferring heat undesirably to adjacent components from a space between the nozzle and the substrate, the conventional nozzles have complicated structures. For example, some conventional nozzles have air flow exhaust passages in the nozzle. Conventional nozzles with complicated structures tend to be unsuitable for high density mounted PCB components due to their size. Reducing the size of conventional nozzles with complicated structures is expensive.

BRIEF DESCRIPTION OF THE PRESENT INVENTION

The present invention details a nozzle design and production method for the nozzle to provide a simple structure for a hot air nozzle having an exhaust path that protects against heat transfer to surrounding electrical components. The nozzle is configured to be mounted on the distal end of a heating device, such as a hand held hot air device connected to a work station. The hot air nozzle provides a uniform temperature environment while suppressing the occurrence of local excess heating. A heated electrical component or object can receive thermal energy by hot air effectively and efficiently, and most of the hot air is exhausted through exhaust holes in the nozzle. There is no complicated structure in the nozzle.

DETAILED DESCRIPTION OF THE INVENTION

Figure 1:
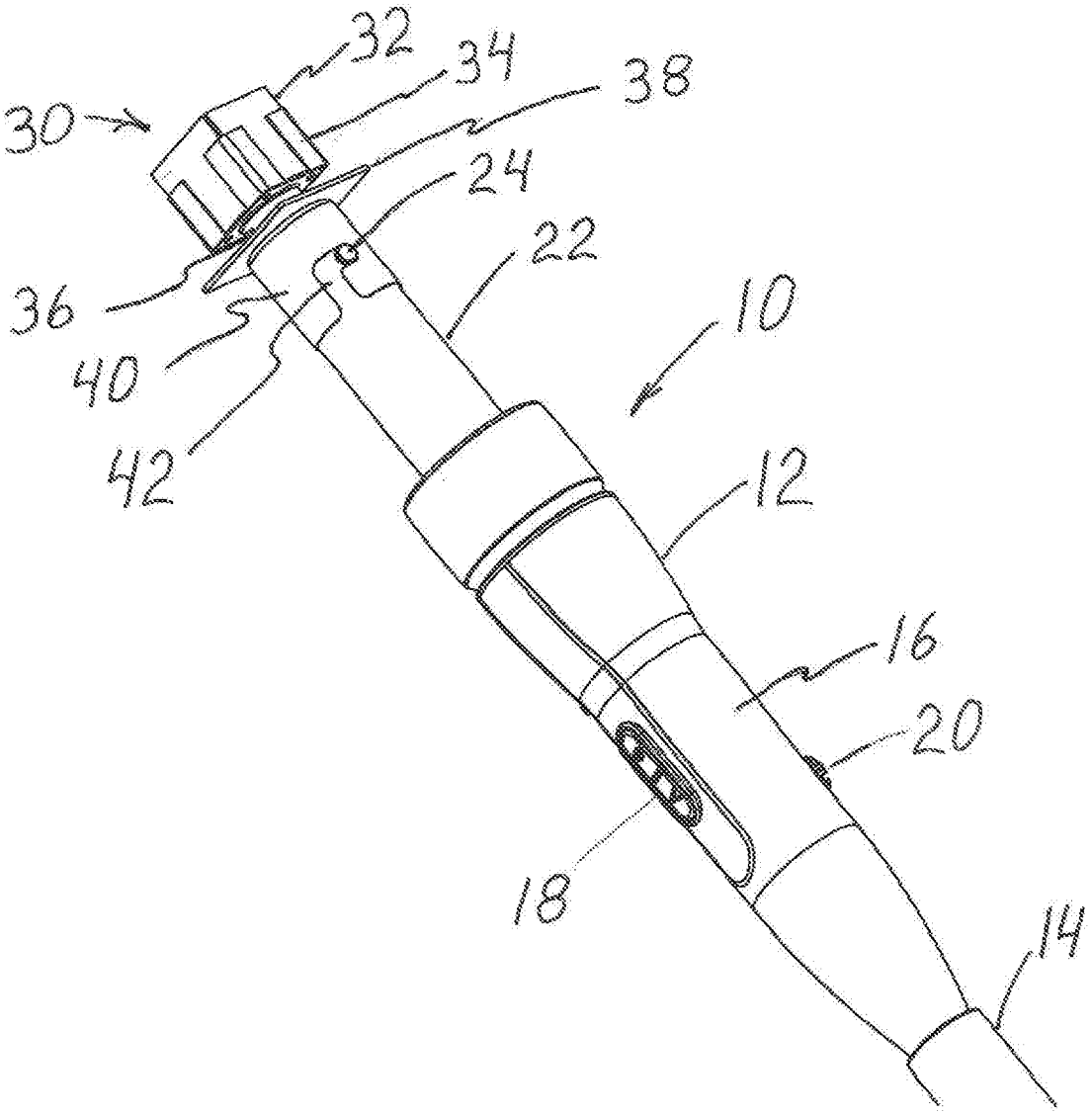
FIG. 1 is a perspective view of a hot air device including a nozzle according to the present invention.

FIG. 1 shows a perspective view of an exemplary handpiece portion of a hot air blower 10. The hot air blower 10 includes a handle section 12 connected at a proximal end to a cable 14 extending to a control box (not shown). The handle section 12 includes an insulated grip 16 as well as a switch 18 and control knob 20. Switch 18 controls the flow of air from the hot air blower 10. Control knob 20 may be used to control the application of a vacuum. The handle section 12 of the hot air blower 10 also includes a blowout cylinder 22 at the distal end, which encloses the heating element. The blowout cylinder is a metallic element having at least one projecting bump 24.

FIG. 1 also depicts the hot air nozzle 30 of the present invention secured to the distal end of the blowout cylinder 22 of the handle section 12 of the hot air blower 10. The hot air nozzle 30 comprises a convection box 32 having corner supports or brace plates 34. The convection box 32 is attached to and extends from a connection cylinder 36 that extends from a baffle plate 38. The baffle plate 38 is secured to an insertion cylinder 40, sized to have an internal diameter that fits snuggly over the distal end of the blowout cylinder 22 of the handle section 12. The insertion cylinder 40 includes at least one J-shaped curved groove 42, configured to accommodate the at least one projecting bump 24 of the blowout cylinder 22, to secure the hot air nozzle 30 to the handle section 12, as shown in FIG. 1.

Figure 2:
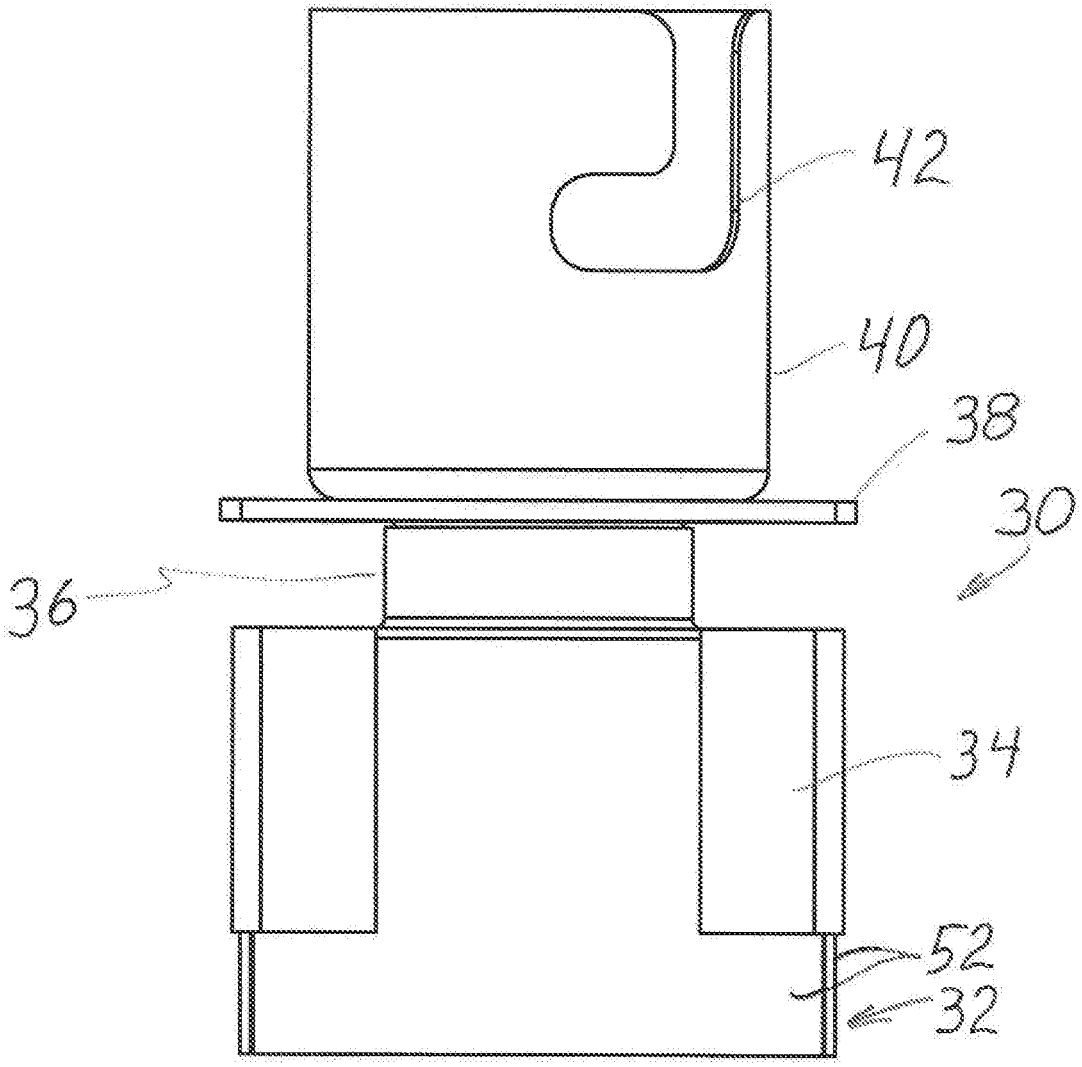
FIG. 2 is a side view of the nozzle of FIG. 1 and the present invention.
Figure 3:
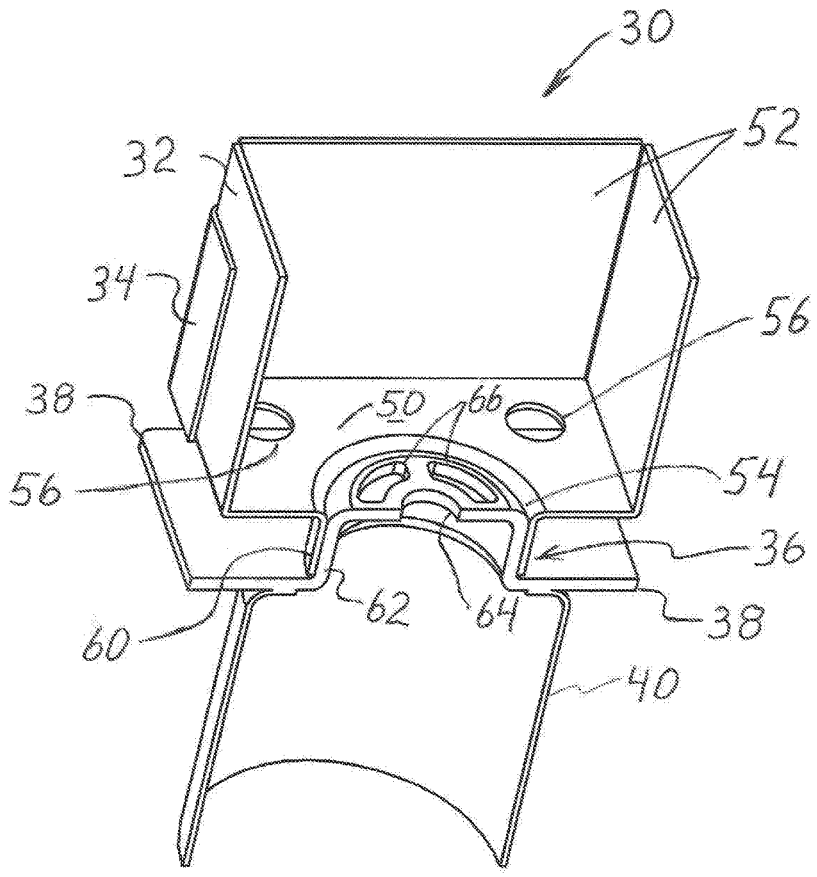
FIG. 3 is a perspective, cut away view of the nozzle of the present invention.

FIG. 2 is a side view and FIG. 3 is a perspective, cut away view of the hot air nozzle 30 of FIG. 1, and accordingly the same reference numbers are included for the components of the hot air nozzle 30. The perspective, cut away view of FIG. 3 depicts additional details of the convection box 32 and the connection cylinder 36. As depicted, the convection box 32 includes an end wall 50 and four side walls 52. The end wall 50 has a large axial orifice 54 as well as spaced apart exhaust ports 56 that are preferably symmetrically placed with respect to said orifice 54.

As it may be seen from the cross section of FIG. 3, the connection cylinder 36 connecting the convection box 32 and the insertion cylinder 40, is made from an outer cylinder 60 and an inner cylinder 62 that projects into the outer cylinder 60. By this structure, the hot air passing through the connection cylinder 36 provides uniform heating in the convection box. The outer cylinder 60 is preferably made from the same piece as, or a flange of, the end wall 50 of the convection box 32 by a burring process. The inner cylinder 62 is preferably made from the same piece as, or a flange of, the baffle plate 38. The inner cylinder 62 may be formed by a deep drawing or stamping of a metal plate forming a cylindrical cup shape. As a result of the forming process, the open end of the cup shaped inner cylinder 62 faces the air flow-in area of the blowout cylinder 22 of the handle section 12 when the nozzle 30 is attached to the handle 12. The end or bottom of the cup shaped inner cylinder 62 formed by the deep drawn or stamping process is drilled or cut to form at least one hole 64, and preferably a plurality of orifices or holes 66, which provide the openings for the passage of hot air from the handle 12 (FIG. 1) to the convection box 32. Alternatively the inner cylinder may also be made by a burring process, configuring a single big hole for the hot air to blow in.

The connection cylinder 36 is formed by inserting the inner cylinder 62 into the outer cylinder 60. The inner cylinder 62 and the outer cylinder 60 may be integrated by welding or press fitting. Alternatively, the inner cylinder 62 and the outer cylinder 60 may be made detachable, so that convection boxes 32 having various sizes and shapes may be used with a common insertion cylinder 40 and baffle plate 38. Preferably, the hot air nozzle 30 is made in three pieces, the convection box 32 including the outer cylinder 60, the baffle plate 38 including the inner cylinder 62, and the insertion cylinder 40. It should be noted that while the convection box 32 depicted and described herein is formed in the shape of an open-ended cube, the convection box 32 may be formed to define other shapes, including cylinders and elongated rectangles configured to fit over the various shapes of electrical circuit components.

Figure 4:
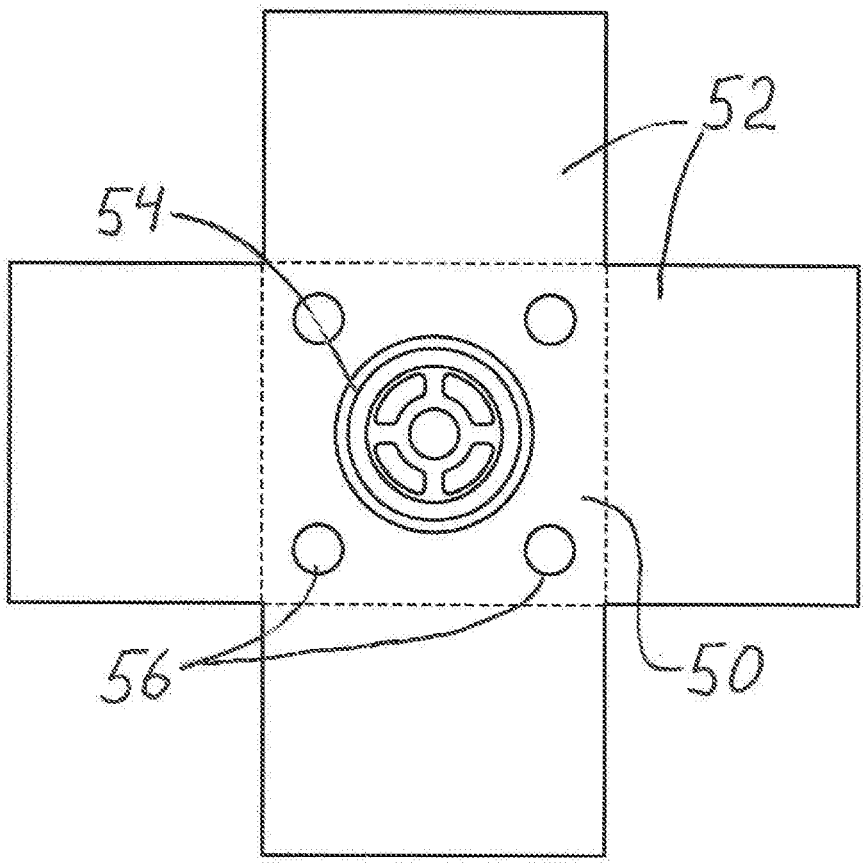
FIG. 4 is an end view of the component to fabricate into the convection box of the nozzle.

To illustrate the fabrication process, FIG. 4 is an end view of the component to fabricate into the convection box of the nozzle of the present invention. FIG. 4 shows a metal plate, formed for example from stainless steel or aluminum, to be fabricated to make the convection box 32. The convention box is made by bending. Four dotted lines in FIG. 4 identify the lines along which the four side walls 52 are bent ninety degrees to the end wall 50. The cross-shaped metal plate is fabricated by punching press or a metal cutting machine. The large axial orifice 54 as well as the spaced apart exhaust ports 56 are formed during the punch press or cutting process before the sidewalls 52 are bent to the final shape depicted in the perspective view of the convection box 32 of the nozzle 30 depicted in FIG. 5.

Figure 5:
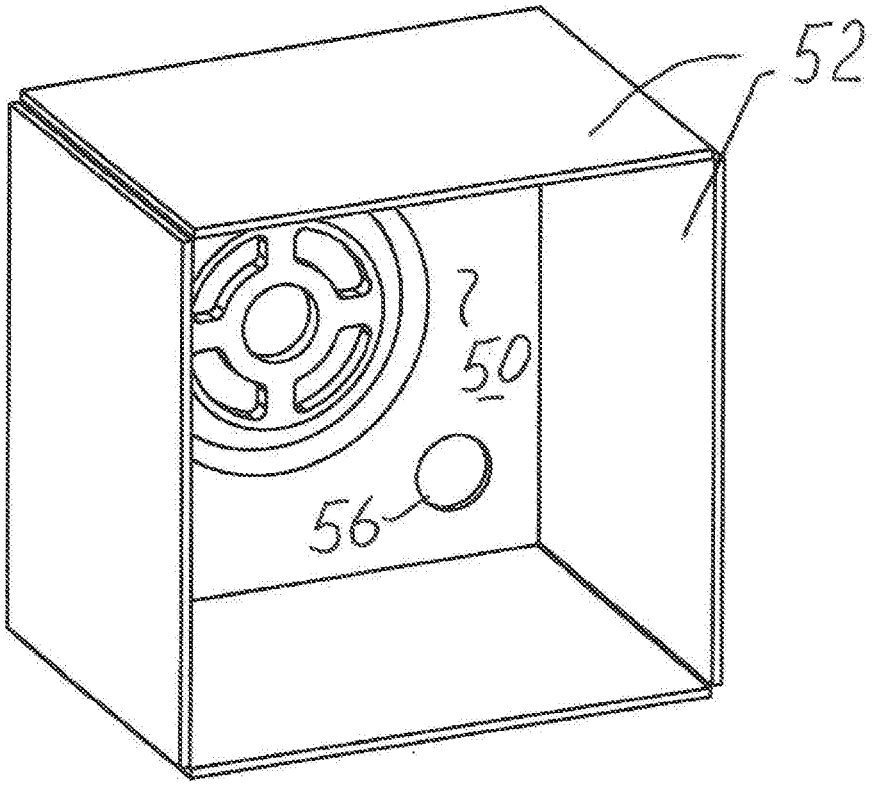
FIG. 5 is a perspective view of the convection box of the nozzle.

FIGS. 4 and 5 depict the convection box 32 with the end or bottom of the cup shaped inner cylinder 62 inserted into the axial orifice 54 formed in the end wall 50. However, in an alternative construction to the configuration described with respect to FIGS. 2 and 3, the end wall 50 of the convection box 32 may be configured to include the least one hole 64, and preferably the plurality of orifices or holes 66 shown in FIGS. 4 and 5, in which case the connection cylinder 36 is simply a cylinder attached at one end to the baffle plate 38 and at the other end to the end wall 50.

Figure 6:
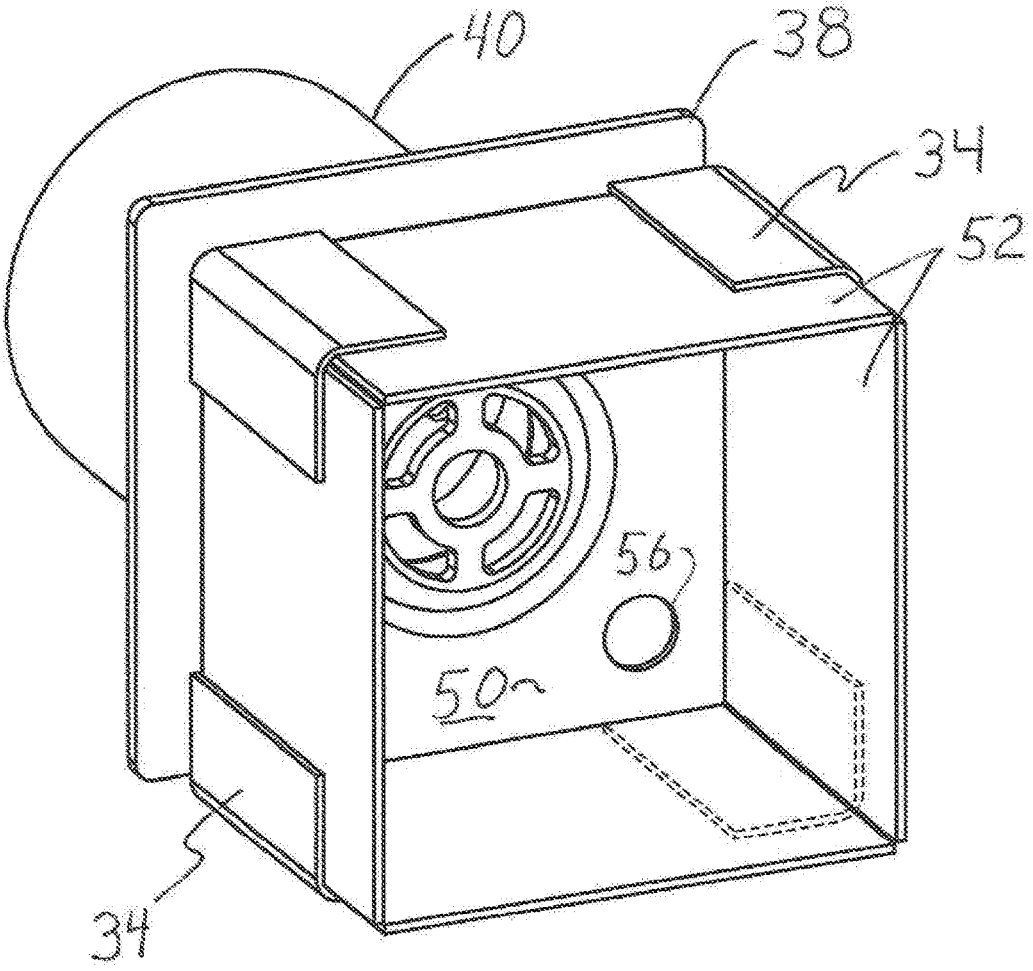
FIG. 6 is a perspective view of the final configuration of the nozzle.

FIG. 6 is a perspective view of the final configuration of the hot air nozzle 30 of the present invention. After the side walls 52 are bent to their final shape, corner supports or brace plates 34 may be secured to, for example by welding, spot welding, or fasteners (not shown), to the edges of the convection box 32 to both strengthen the convection box 32 and reduce air leakage at the seams.

The spacing between the opposing faces of the end wall 50 of the convection box 32 and the baffle plate 38 created by the length of the connection cylinder 36 allows the heated air to exhaust from the convection box 32 through the exhaust ports 56 and the exhausting hot air flow impinges on the baffle plate 38 and is thereby deflected radially outward so as to avoid injuring the user's hand holding the handle section 12 at the insulated grip 16. Preferably, the baffle plate 38 is slightly larger than the end wall 50. Due to the height of the side walls 52, the hot air is exhausted sufficiently above the work surface and the electrical components mounted thereupon to avoid damaging the surrounding circuitry.

In operation, the convection box 32 defines a convection space. The convection box 32 is placed over the surface of the substrate to be heated with the distal edges of the side walls abutting the surface of the substrate, for example a printed circuit board (PCB), and the peripheral side walls 52 prevent the hot air from flowing onto surrounding electric components. The shape of the end wall 50 is preferably the same as the shape defined by the distal edges of the side walls. Hot air enters the convection box 32 via the holes 64 and 66. The hot air is convected in the convection space exhausting through the exhaust ports 56. Therefore, electronic components adjoining the targeted component are not exposed to thermal energy of the hot air. Hot air from the hole is convected in the convention space and the thermal energy is transmitted to the targeted element properly.

The convection space in the convection box 32 extends from the holes 64 and 66 to the peripheral side walls 52 and the surface of the workpiece. As a result, hot air provides thermal energy to the targeted electronic component uniformly without causing excessive low temperature or high temperature locally. The user can dismount electrical components with high reliability.

To transmit thermal energy to a heated object such as a solder connection, an electronic element or a substrate, it is preferable to circulate hot air uniformly inside a nozzle's convection box. The present invention provides a convection box having a simple structure which can convect hot air in a confined space bounding the object to be heated. Those skilled in the art will readily appreciate that the disclosure herein is meant to be exemplary and actual parameters, shapes and materials depend upon the specific application for which the present invention is intended. The foregoing embodiments are presented by way of example while the scope of the invention is defined by the appended claims and equivalents thereto.

The invention claimed is:

1. A hot air nozzle for use with a hot air blowing device or system, the hot air nozzle comprising:

a convection box secured to a connection cylinder extending from a baffle plate and an insertion cylinder removeably secured to said hot air blowing device; wherein said convection box includes an end wall and side walls defining a convection space, said end wall having at least one air inlet orifice and spaced apart exhaust ports whereby hot air exhausting from said convection space impinges upon said baffle plate positioned opposing said end wall and spaced apart by a length of said connection cylinder.

2. The hot air nozzle of claim 1, wherein said connection cylinder further comprises: an outer cylinder and an inner cylinder that projects into the outer cylinder.

3. The hot air nozzle of claim 2, wherein said inner cylinder further comprises a generally cup shaped structure with the bottom of the cup shaped structure cut to form at least one hole for the passage of hot air to the convection box.

4. The hot air nozzle of claim 2 wherein said outer cylinder is securely affixed to said inner cylinder.

5. The hot air nozzle of claim 2 wherein said outer cylinder is removably affixed to said inner cylinder.

6. The hot air nozzle of claim 1 wherein said convection box is removably secured to said connection cylinder whereby a plurality of convection boxes having various sizes and shapes is secured to a common connection cylinder.

7. A hot air nozzle for use with a hot air blowing device or system, the hot air nozzle comprising:

a convection box secured to a connection cylinder extending from a baffle plate and an insertion cylinder removeably secured to said hot air blowing device; wherein said convection box includes an end wall and side walls defining a convection space, said end wall having at least one air inlet orifice and spaced apart exhaust ports whereby hot air exhausting from said convection space impinges upon said baffle plate positioned opposing said end wall and spaced apart by a length of said connection cylinder; wherein said connection cylinder further comprises an outer cylinder made from the same piece as said end wall of the convection box and an inner cylinder is made from the same piece as the baffle plate.

8. The hot air nozzle of claim 7, wherein said outer cylinder is formed by a burring process and said inner cylinder is formed by a deep drawing or stamping of a metal plate process.

9. A hot air nozzle for use with a hot air blowing device or system, the hot air nozzle comprising:

a convection box having an end wall having a hot air inlet and side walls extending from said end wall;

a connection cylinder;

a baffle plate; and an insertion cylinder, said insertion cylinder attached at its distal end to said baffle plate, said insertion cylinder configured to be attached securely to said hot air blowing device;

wherein said connection cylinder extends between said baffle plate and said convection box whereby exhaust ports formed in said end wall of said convection box are oppositely disposed to said baffle plate whereby hot air exhausting from said convection box impinges upon said baffle plate.

10. The hot air nozzle of claim 9, wherein said connection cylinder further comprises:

an inner cylinder integrally formed with said baffle plate; and an outer cylinder integrally formed with said end wall of said convection box, said outer cylinder having an inner diameter sized to fit over said inner cylinder.

11. The hot air nozzle of claim 9, wherein said convection box is removably secured to said connection cylinder.

* * * * *